United States Patent [19]

Sundström

[11] 4,061,080

[45] Dec. 6, 1977

[54] POSITION REGULATOR

[75] Inventor: Nils Eskil Sundström, Sodertalje, Sweden

[73] Assignee: AB Westin & Backlund, Stockholm, Sweden

[21] Appl. No.: 697,963

[22] Filed: June 21, 1976

Related U.S. Application Data

[63] Continuation-in-part of Ser. No. 605,294, Aug. 18, 1975, Pat. No. 3,978,884.

[30] Foreign Application Priority Data

Mar. 3, 1976 Sweden ..... 7602986

[51] Int. Cl.[2] ..... F01B 7/00

[52] U.S. Cl. ..... 92/13.2; 92/13.3; 92/63

[58] Field of Search ..... 92/13.2, 13.3, 50, 62, 92/63

[56] References Cited

U.S. PATENT DOCUMENTS

| | | | |
|---|---|---|---|
| 2,551,246 | 5/1951 | D'Arcey | 92/63 X |
| 2,936,785 | 5/1960 | Hastings | 92/50 X |
| 3,187,640 | 6/1965 | Young | 92/63 X |
| 3,424,062 | 1/1969 | Gummer | 92/63 |

*Primary Examiner*—Robert G. Nilson
*Attorney, Agent, or Firm*—Schiller & Pandiscio

[57] ABSTRACT

A position regulator is provided which is effective to control, via a control unit, a pressure medium circuit to operate at different working pressures. The regulator comprises two or more pressure transmitting elements which divide an internal space into a number of pressure chambers, the pressure transmitting elements being arranged for axial movement within the position regulator. The invention provides pressure transmitting elements defining the pressure chambers which comprise diaphragms or the like which are attached in mutually spaced relationship in the position regulator and which, when subjected to a force, permit axial displacement movements.

6 Claims, 2 Drawing Figures

POSITION REGULATOR

Figure 1:
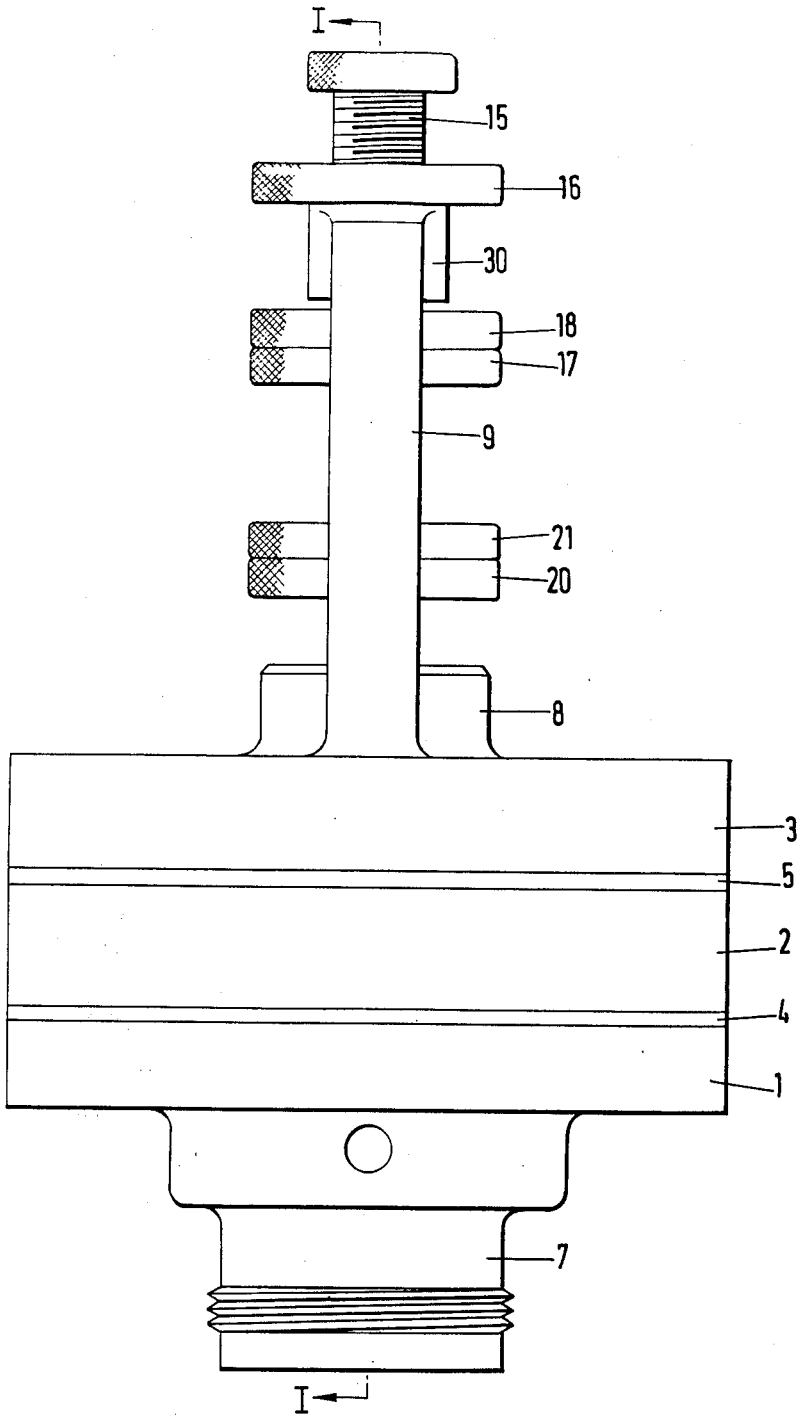

The present invention is a continuation-in-part of my co-pending application Ser. No. 605,294, filed Aug. 18, 1975, now U.S. Pat. No. 3,978,884.

In my aforesaid co-pending application Ser. No. 605,294, there is disclosed a position regulator comprising at least two pressure-transmitting elements which divide an internal space in the position regulator into a number of pressure chambers, pressure medium being supplied to and dscharged from said chambers in response to control means, so as to cause, via the pressure-transmitting elements, an output shaft or the like displaceably mounted in the position regulator to adopt a number of axially determined positions, with the aid of individually adjustable stop means for respective pressure-transmitting elements. In accordance with one embodiment of the position my aforesaid co-pending application, Ser. No. 605,294, the internal space has the form of a cylinder and the pressure-transmitting elements comprise at least two pistons which are displaceably mounted relative to each other, at least one piston having an axial extension which passes through the cylinder and which comprises the output shaft of the position regulator.

Such a position regulator satisfies the high requirements placed on precision and length of useful life. In order to meet these requirements, however, the regulator must be made of expensive material and is consequently costly to manufacture. In addition, such a position regulator, which is a compact unit, is relatively heavy.

An object of the present invention is to provide a position regulator which is of simpler construction than that of any aforesaid co-pending application and which is both less expensive and lighter. A further object is to provide such a regulator with readily accessible adjustment means, such that the concept of the invention can be utilized in a larger number of fields than was possible with the position regulator of my aforesaid co-pending application. With the pressure regulator of the present invention the pressure-transmitting elements defining the pressure chambers comprise diaphragms which are mounted in mutually spaced relationship in the position regulator and which, when subjected to a force, cause shafts to move axially in the regulator. Each diaphragm is attached to a respective shaft displaceably mounted in the position regulator, one diaphragm being attached to a main shaft which extends through the pressure chambers and one end of which forms the output shaft of the position regulator, while each of the remaining diaphragms is attached to a respective cylindrical shaft mounted directly and/or indirectly on the main shaft. The shafts are arranged to extend through a rear end wall of the position regulator and arranged on the outer ends of respective shafts are individually adjustable stop means which co-act with fixed abutment surfaces on a rear holder in the position regulator so as to control the length of stroke of respective diaphragms. Other characteristic features of the invention are disclosed in the appended claims and will be described hereinafter with reference to an embodiment of the invention.

Figure 2:
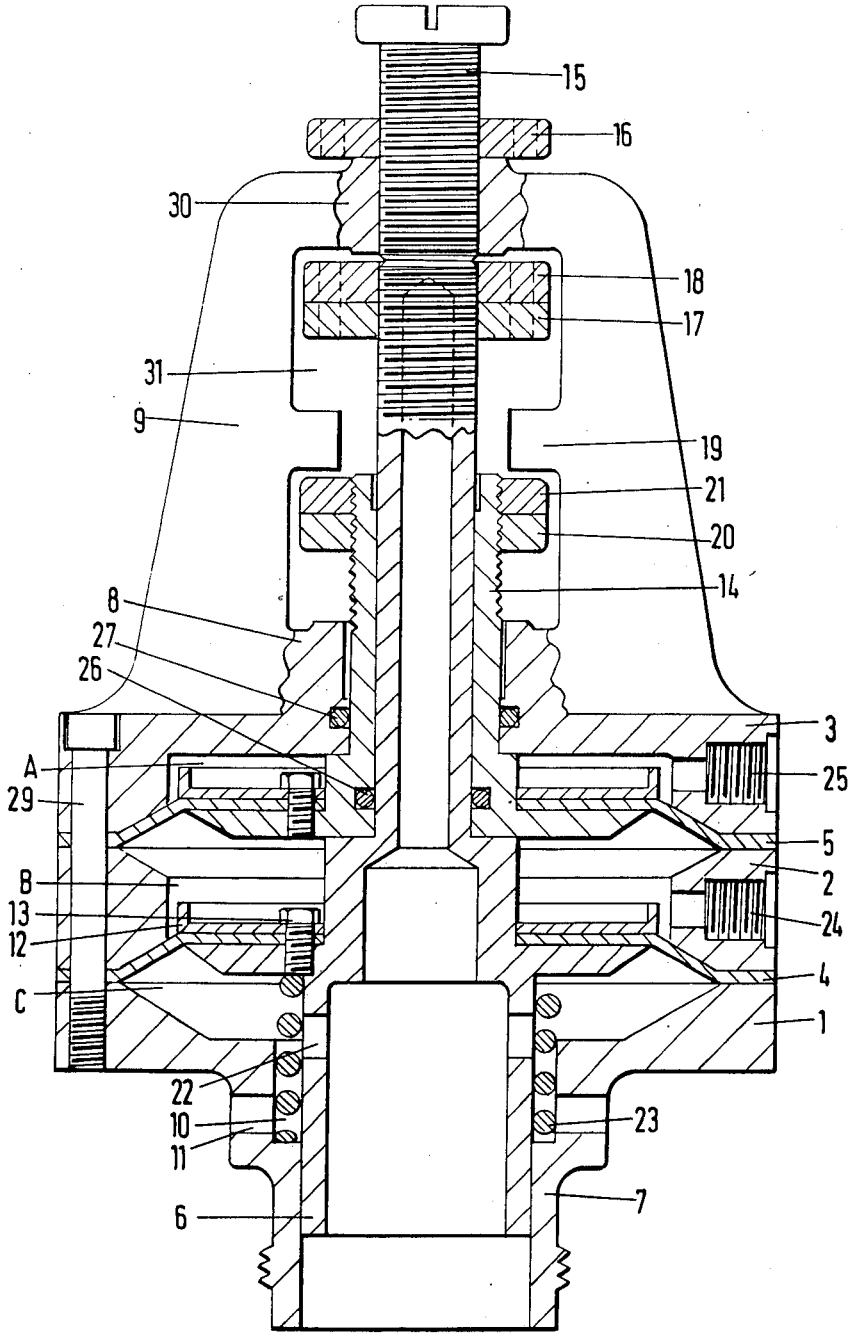

The subsequent description is made with reference to the accompanying drawings, in which FIG. 1 is a longitudinal view of a position regulator constructed in accordance with the invention and FIG. 2 is a longitudinal sectional view taken through the line I—I of FIG. 1.

The main body of the position regulator comprises three units which are fixedly secured together, a forward end wall 1, an intermediate member 2 and a rear end wall 3, which together enclose an internal space in the position regulator. The intermediate member 2 and the end walls have a substantially cylindrical shape. Mounted between the forward end wall 1 and the intermediate member 2, and also between the intermediate member 2 and the rear end wall 3 are diaphragms 4, 5. The aforementioned units are combined to form a common main body of the position regulator by means of axially extending screws 29 uniformly distributed in a circular ring and passing through said units.

The forward end wall 1 is provided with a cylindrical neck portion 7. The neck portion 7 is provided with an external screw thread for connection to a control unit or a fixture (not shown). Displaceably mounted in the cylindrical neck portion 7 is one end of a main shaft 6 which forms the output shaft of the position regulator. The forward end wall 1 is provided internally with a conical recess which forms part of the total internal space of the position regulator. This part of the internal space, hereinafter designated chamber C, communicates with atmosphere through a shoulder-forming widened portion 10 of the through-passage of the cylindrical neck portion and a hole 11 extending radially through said neck portion 7 into said widened portion 10.

The intermediate member 2 is annular in shape and is provided on either side thereof with a conical recessed portion corresponding to the recessed portion on the inside of the forward end wall 1. These recesses are designed to permit freedom of axial movement of the diaphragms 4, 5. To the same end, the inner surface of the rear end wall 3 is provided with a conically recessed portion which extends into a shoulder-forming cylindrical recess. On the outside, the rear end wall 3 is provided with a substantially cylindrical hub 8 and a holder 9 associated therewith. The holder 9 has the form of a plate and extends transversely over the rear end wall 3. The holder 9 narrows rearwardly in an axial direction to form a closed stirrup having an opening 31 arranged between the hub 8 and the web 30 of the stirrup.

The main shaft 6 extends axially through the rear end wall 3, and displaceably mounted on the main shaft 6 is a tubular shaft 14 which in turn is displaceably mounted in the rear end wall 3. The forward diaphragm 4 is attached to a flange on the main shaft 6 by means of a support plate 12 and a number of screws 13 disposed in a ring. The rear diaphragm 5 is attached to a flange on the tubular shaft 14 in a similar manner. Both of the shafts 6, 14 are provided with shoulder which limit the respective rearward positions of the shafts in the position regulator.

The rearward position of the main shaft 6 can be adjusted with respect to different lengths of stroke of the diaphragm 4. To provide for such adjustment, there is mounted on the web 30 of the stirrup on the holder 9, an axial adjuster screw 15 which is arranged to abut the rear end of the main shaft 6 in its rearmost position. A shaft position set by means of the adjuster screw 15 is locked by means of a locking nut 16 which urges against the rear surface of the holder 9.

The forward position of the main shaft 6 can be adjusted by means of setting means 17 and locking means 18 mounted on the rear end of the shaft, said setting means and locking means being arranged to limit the forward displacement movement of the main shaft 6 by abutment with a fixed shoulder 19 in the holder opening 31. Similarly, setting means 20 and locking means 21 mounted on the rear end of the tubular shaft 14 can limit the forward movement of the tubular shaft 14 by abutment with the end surface of the hub 8 in the rear end wall 3.

In order to minimize on weight, the main shaft 6 is provided along the major portion of its length with an abutment-forming bottom hole. The bottom hole is in open communication with the chamber C through a radial hole 22 in the output end of the output shaft 6, and consequently said bottom hole is also in communication with stmosphere through the hole 11. A pressure spring 23 arranged in the cylindrical widened portion 10 of the cylindrical neck portion 7, is arranged to bear against the flange on the main shaft 6 and to cause said main shaft 6 to adopt a rear starting position, the main shaft 6, through an abutment shoulder, causing the tubular shaft 14 to adopt said rear position.

A space defined between the diaphragms 4, 5 in the position regulator, hereinafter referred to as chamber B, is connected with the control means (not shown) of a pressure-medium circuit through a radial inlet hole 24, formed in the intermediate member 2, and a line connection (not shown) associated with said hole 24. A space arranged between the rear diaphragm 5 and the rear end wall 3, hereinafter referred to as chamber A, is connected in a similar manner with the pressure-medium circuit through a radial inlet hole 25 in the cylindrical end wall.

In response to control means, pressure-medium is passed to the chambers A and/or B, whereupon the main shaft 6 is caused to be coresspondingly displaced axially forwards. Sealing of the pressure chambers A and B is obtained by means of a sealing ring 26 arranged between the main shaft 6 and the tubular shaft 14 and a sealing ring 27 arranged between the tubular shaft 14 and the rear end wall 3.

The exemplified position regulator is connected to a compressed-air circuit and the control means (not shown) comprises a three-path valve which determines to which chamber A, B, air under pressure shall be fed. As will be understood from the aforegoing, the diaphragms 4, 5 are axially displaceable both individually and together. In the starting position, which constitutes the first control position of the position regulator, the main shaft 6 abuts the setting screw 15 under the action of the spring 23. The tubular shaft 14 then adopts a position between a shoulder on the main shaft 6 and the inside of the rear end wall 3. In order to obtain the second control position, compressed air is fed into the chamber A, whereupon the diaphragm 5 forces the tubular shaft 14 forwards until stop means 20, 21 arranged on the tubular shaft 14 are brought into abutment with the stop surface on the hub 8. The main shaft 6 is entrained with the forward movement of the tubular shaft 14 and adopts a regulated position dependent thereupon. In order to obtain a third regulated position, which corresponds more or less to the maximum length of stroke, compressed air is fed into the chamber B. The diaphragm 5 is then pressed rearwardly so that the tubular shaft 14 abuts the inside of the rear end wall 3 and the diaphragm 4 is pressed forwards so that the main shaft 6 with its stop means 17, 18 is moved into abutment with the stop shoulder 19 in the holder opening 31.

Thus, these different regulating functions enable the output shaft of the position regulator to be moved to three axially determined positions. Such regulation is of great importance for the adjustment of position regulators, although it can also be utilised in other fields of use in which high requirements are placed on precise length adjustments. A position regulator constructed in accordance with the invention preferably comprises a separate unit which can be connected to known control units, although it is possible within the scope of the invention to incorporate the position regulator in a control unit of some other kind, for example a pressure regulator. For this latter purpose it is important that the adjusting means and stop means are position on the end of the position regulator opposite the end of the output shaft.

The invention is not restricted to the described three-position regulator since it is possible to provide more than two diaphragms in the internal space of a position regulator so as to obtain a larger number of pressure chambers. The diaphragms may conveniently comprise leather, synthetic resin or rubber, although they may also be made of metal. The diaphragms are preferably planar in form so as to permit axial displacement movements, although the concept of the invention also includes diaphragms in the form of so-called roller diaphragms or bellows.

As will be evident in the foregoing, the position regulator in accordance with the invention, can be modified for a number of different fields of use. The invention is thus not restricted to the described embodiment, but can be modified within the scope of the following claims.

I claim:

1. A position regulator comprising at least two pressure-transmitting elements (4, 5) which divide an internal space in said position regulator into a number of pressure chambers to which pressure medium is passed and from which pressure medium is conducted away in response to control means so as, via said pressure-transmitting elements (4, 5) to cause an output shaft (6) or the like displaceably mounted in said position regulator to adopt a number of axially determined positions in dependence upon individually adjustable stop means for respective pressure-transmitting elements, wherein said pressure-transmitting elements defining said pressure chambers comprise diaphragms (4, 5) or like means which are attached in mutually spaced relationship in said position regulator and which, when subjected to a force, permit axial displacement movements.

2. A position regulator according to claim 1, wherein said diaphragms (4, 5) are each mounted to a shaft (6, 14) displaceably arranged in said position regulator.

3. A position regulator according to claim 2, wherein one diaphragm (4) is mounted to a main shaft (6) which extends through said pressure chambers, one end of said main shaft (6) forming the output shaft of said position regulator, and wherein the remaining diaphragms (5) are mounted on tubular shafts (14) which are concentric mounted on said main shaft (6).

4. A position regulator according to, claim 3 wherein the chambers defined in the internal space in said position regulator by said diaphragms (4, 5) or the like, are all (A, B), with the exception of one, connected with one and the same pressure-medium circuit through radial inlet passages (24, 25) whilst a chamber (C) not connected with said pressure-medium circuit is in communication with atmosphere through at least one opening (10, 11).

5. A position regulator according to claim 4, wherein said shafts (6, 14) extend through a rear end wall (3) of said position regulator, the respective outer ends of said shafts (6, 14) being provided with individually adjustable stop means (17, 18, 20, 21) which co-act with fixed stops (8, 19) on a rear holder (9) in said position regulator so as to regulate the length of stroke of respective diaphragms (4, 5).

6. A position regulator according to claim 4, wherein a pressure spring (23) is arranged, when respective pressure chambers (A, B) are pressureless, to displace said shafts (6, 14) to starting positions determined by setting means (15) and locking means (16).

* * * * *